US005509753A

United States Patent [19]

Thompson

[11] Patent Number: 5,509,753

[45] Date of Patent: Apr. 23, 1996

[54] RETRACTABLE SPEED BUMP

[76] Inventor: Clinton C. Thompson, 3437 Newburg Rd. #5, Louisville, Ky. 40218-2419

[21] Appl. No.: 343,186

[22] Filed: Nov. 22, 1994

[51] Int. Cl.[6] ..... E01F 9/00

[52] U.S. Cl. ..... 404/6; 404/11; 49/49

[58] Field of Search ..... 404/6, 9–10, 12, 404/15; 14/69.5, 71.1, 71.3; 49/49

[56] References Cited

U.S. PATENT DOCUMENTS

| | | | |
|---|---|---|---|
| 1,603,846 | 10/1926 | Garcia . | |
| 3,447,429 | 6/1969 | Bowersox | 94/1.5 |
| 3,902,213 | 9/1975 | Pfleger et al. | 14/71.3 |
| 4,012,156 | 3/1977 | Turner et al. | 404/15 |
| 4,101,235 | 7/1978 | Nelson | 404/6 |
| 4,342,525 | 8/1982 | Mastronuzzi | 404/6 |
| 4,354,771 | 10/1982 | Dickinson | 404/6 |
| 4,362,424 | 7/1983 | Barber | 404/6 |
| 4,490,068 | 12/1984 | Dickinson | 404/6 |
| 4,697,294 | 10/1987 | Shäfer | 14/69.5 |
| 4,752,152 | 6/1988 | Crisp et al. | 404/6 |
| 4,775,261 | 10/1988 | Fladung | 404/6 |
| 4,815,889 | 3/1989 | Duckett | 404/6 |
| 4,974,991 | 12/1990 | Mandavi | 404/6 |
| 4,995,756 | 2/1991 | Kilgrow | 404/6 |
| 5,267,808 | 12/1993 | Welford | 404/11 |

FOREIGN PATENT DOCUMENTS 9200116 1/1992 European Pat. Off. .

*Primary Examiner*—Ramon S. Britts
*Assistant Examiner*—Pamela A. O'Connor
*Attorney, Agent, or Firm*—John F. Salazar; Middleton & Reutlinger

[57] ABSTRACT

A motorized retractable speed bump or warning device wherein the raising and lowering of the retractile is controlled by multiple remote means from signals generated by traffic conditions. The motorized retractable speed bump, wherein a retractile comprising of bi-folding hinged plates, which are elevated to present a visible obstruction to motor vehicles, and a position restraining device, operated by rotary and or linear motor drive means, by on/off manual push button switching, or through a series of Programmable Logic Controllers, by way of analog or digital signals emanating from permanently mounted speed detecting devices.

7 Claims, 4 Drawing Sheets

RETRACTABLE SPEED BUMP

BACKGROUND OF INVENTION

1. Field of Invention

The present invention generally relates to a vehicle speed control means, and more particular to an improved vehicle speed bump which incorporates one or more devices for vehicle speed sensing, a system of controls for extending and retracting the bump, allows un-impeded cleaning of the road surface by mechanical equipment such as, road sweepers, mobile vacuum cleaners, snow plows and the like, and provide positive drainage of rainfall or melted snow.

2. Prior Art

Speed bumps are utilized as active warning devices for motorists, by creating a nuisance which results in the form of vibrations on a the wheels of a moving vehicle, such vibrations having an annoying effect on the operator and passengers within the vehicle.

The use of these devices in school parking lots, exits and entrances to parking lots and the like, driveways, roadways, highways, approaches to construction zones, tollways, toll booth vicinities, and other controlled crossings, is well known. Most of the existing speed bumps are merely spaced rubber, steel, concrete or asphaltic bars, secured on the top of the roadway surface, and are severely subject to deterioration due to the effects of varying weather conditions and continuous traffic over them, while in their singular, static positions.

Moreover, they do not retract to prevent slow moving and/or emergency vehicles, such as ambulances, fire trucks, law enforcement vehicles and school busses, from being jolted when passing over the bumps, and in some cases they are susceptible to damage by, and to, road surface cleaning and snow plowing mechanical equipment operations.

See, for example, the speed bumps of U.S. Pat. Nos. 4,362,424; (Barber) U.S. Pat. No. 4,697,294; (Schafer), U.S. Pat. No. 5,106,226; (Fanslow et al.) and U.S. Pat. No. 4,974,991; (Mandavi), some of which are of improved design but essentially of the same basic type.

Certain other speed bumps have been devised, in which the bumps can be extended or retracted, as needed, either by mechanical tools (see U.S. Pat. No. 4,012,156—Turner et al. ), or by remotely operated hydraulic pistons (See U.S. Pat. Nos. 4,342,525—Mastronuzzi; U.S. Pat. No. 4,354,771—Dickinson and U.S. Pat. No. 4,490,068—Dickinson.)

However, not all of these devices allow for the slow moving vehicles to negotiate them without sustaining a jolt, nor do they provide for immediate retraction or extension on signal from priority vehicles such as police, fire trucks, school busses, locomotives approaching level railroad crossings and the like.

Accordingly there remains a need for an improved speed bump which can be extended and/or retracted, by remote control signalling, emanating from emergency and priority vehicles, be manually operational from local controls, automatically operational at set periods of time, and operational by vehicle speed sensing device remotely located to detect approaching vehicle speeds at a pre-determined distance from the speed bump.

Such a speed bump device should be durable, cost effective be adjustable to road surface grade elevations increases due to road resurface repaving operations, allow for efficient and non-destructive roadway sweeping, snow removal, provides positive drainage of rainfall, is inherently safe to traverse in both directions whether in the raised or retracted positions and require only basic preventive maintenance servicing. The speed bump device should, in addition be capable of being mounted as a singular unit, or multiples wherein they are connected in series or parallel configurations.

Accordingly, it is the object of this invention to provide an improved retractable speed bump which meets all these conditions, and provide, in a particular application, additional warning of approaching railroad traffic at "railway-street/road" intersections, wherein speed bumps are activated by way of the signalling from the approaching locomotive, or rail-road crossing light signal control unit.

SUMMARY OF INVENTION

The improved vehicle speed bump device contained in this present invention satisfies all the foregoing needs. The device is substantially as set forth in the Abstract of the Disclosure.

The speed bump is designed to elevate bi-folding rectangular plates to present a visible obstacle above the surface of the roadway or street, and to cause jolting or bumping of a vehicle when the tires comes into contact with the obstacle at a high rate of speed.

A curved surface is formed where the two longitudinal edge of the inclining and declining plates connect, to provide surface which permits a non-destructive bumping of the rotating wheels of the motor vehicles, while permitting safe negotiation over the speed bump.

The retractable speed bump in this invention may be controlled remotely, and of a preferred embodiment, is characterized by a rectangular encasement which is recessed into the roadway surface and within which is mounted, the shaft supporting bearings, a shaft which supports two rectangular plates, connected to each other by roll hinges installed along their longitudonal bi-folding edges, and in another preferred embodiment, a bump position locking device.

The shaft is rotated along its axis by means of a motorized, rotary or linear operator, to present both rotational and translational movement to the bi-folding plates. In the extended position, the retractile is held in position and restrained by a lock built into the operator, or as may be required, a mechanical locking device which secures the shaft in the preferred angular position, such device being of the form of a 'rachet' or 'paul' configuration, requiring minimal or zero energy, while in the shaft restraining position.

In the multiple parallel configuration, two or more of these units are installed in the roadway to produce consecutive bumps of the "Rumble Strip" type. The drive arms of these units in this configuration, are linked by one or more connecting rods, and to one or more motorized linear actuators.

The series coupled configuration is used to accommodate the speed bump to dual or multiple lane traffic situations. Two or more of these units are directly coupled at the shafts, to provide a configuration wherein the devices span the active lanes of the uni-directional portion of the roadway, operated in unison by a single or multiple, motorized linear or rotational operators, and as required, incorporating the additional shaft locking device.

DETAILED DESCRIPTION

Figure 1:
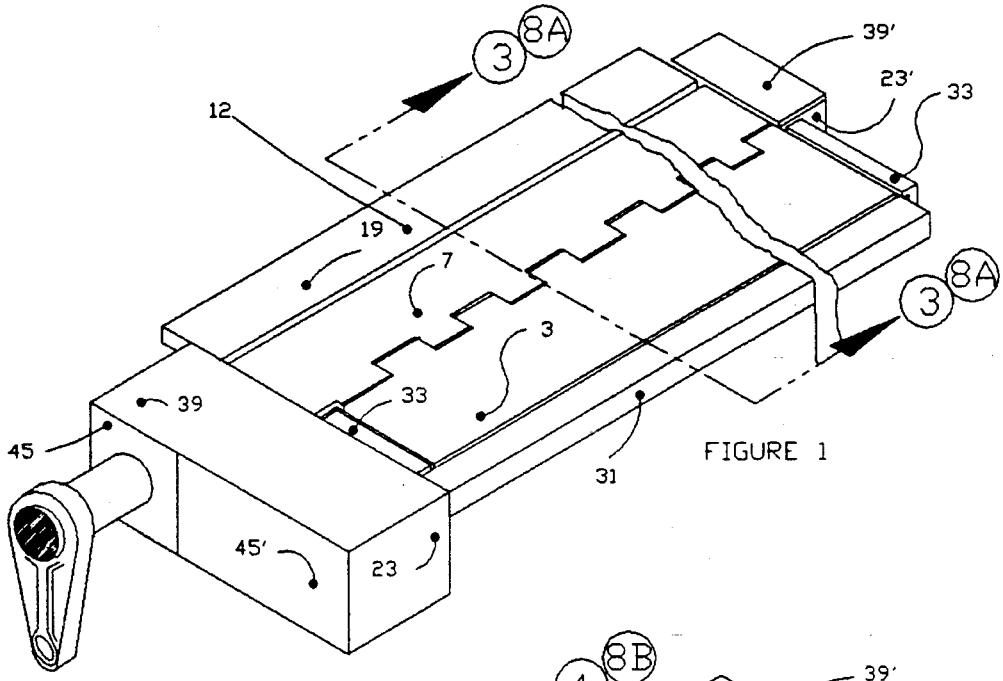
FIG. 1 is a schematic perspective view of a retractable speed bump installation embodying the present invention in the retracted configuration, installed in a section of the roadway or street.
Figure 2:
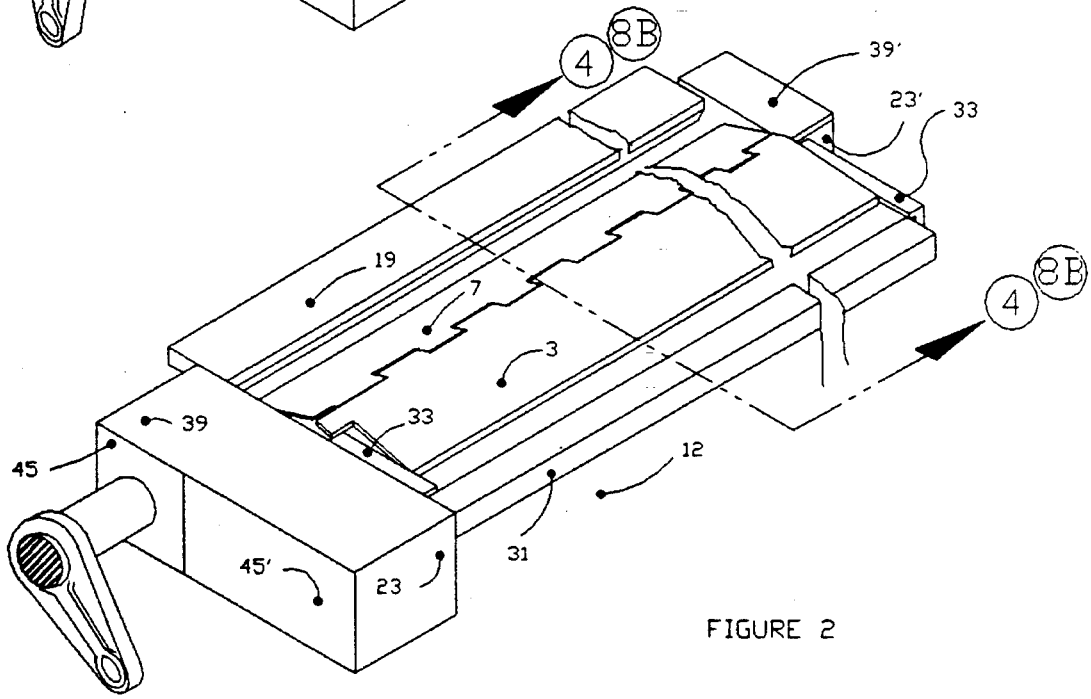
FIG. 2 is a schematic perspective view of a retractable speed bump installation embodying the present invention in the extended configuration, installed in a section of the roadway or street.

Referring to FIGS. 1 & 2 of the drawings, the retractable speed bump of this invention is generally illustrated by the reference numeral 12, and a single speed bump occupying one traffic lane of the roadway is shown in the retracted position, FIG. 1, and in the raised/extended position, FIG. 2.

A preferred embodiment of the improved vehicle speed bump device of the present invention is schematically depicted in FIGS. 1 & 2 of the drawings. The device 12 is shown, which comprises a rigid container of components 19, 21, 23 23', 25, 29, 31, 39, 39', 45, 47 and 53, (some of which are not exposed in these views) having one or more sets of removable interlocking bump plates 3 and 7, connected by a plurality of roll hinges 5, to create a bi-folding structure, all of which are constructed of material such as steel or other durable metal. Plate 7 is secured by weldment, or recessed bolting to a structural bracket comprising of a longitudinal plate, 9, which is rigidly connected to the shaft 13, by a plurality of reinforcement plates, 11.

The device 12 further includes, a paired set of preferably generally cylindrical shaped, guide pins 1*a* and 1*b*, fitted to plate 3, and extending into the slot of a chanelled guide plates 33, all constructed of steel, or other durable wear resistant low friction materials. (See also FIG. 5.)

The improved speed bump device 12, further includes a single, or multi-diameter shaft 13, supported by a plurality of axially aligned bearings 17, an end and collar plate 45 & 45', and a shaft positioning arm 41, secured to the drive end of the shaft 13. The arm 41, in this instance, is provided to rotate the shaft 13 to the desired position, wherein the plates 7 and 3, configure to the extended/active or the retracted/inactive positions.

In still another preferred embodiment of the improved retractable speed bump of this invention, the device 12, further includes a single, or multi-diameter shaft 13 on which is fixed, a plurality of radially aligned, shaft positioning stops item 15, a plurality of axially aligned bearings 17, a shaft collar and end plate 45/45', and a shaft positioning arm 41 secured to the drive end of shaft item 13.

Figure 3:
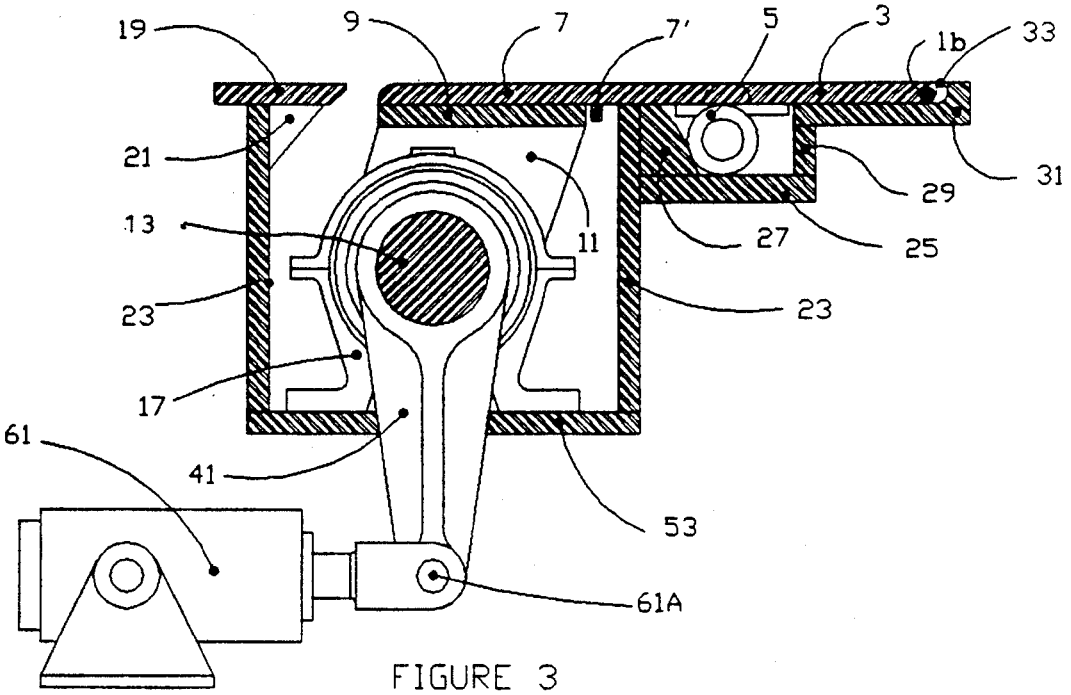
FIG. 3 is a partial sectional view taken along lines 3—3 in FIG. 1, more particularly illustrating the components of the retractable speed bump in the retracted configuration.

Referring to FIG. 3 of the drawings, a cross sectional view of a preferred embodiment of the device 12, is shown in the retracted/flat position, installed in the roadway, more clearly exposing the layout of the components included in FIGS. 1 & 2. In the retracted position so formed, the bump plates are flat and level with the roadway surface.

Figure 4:
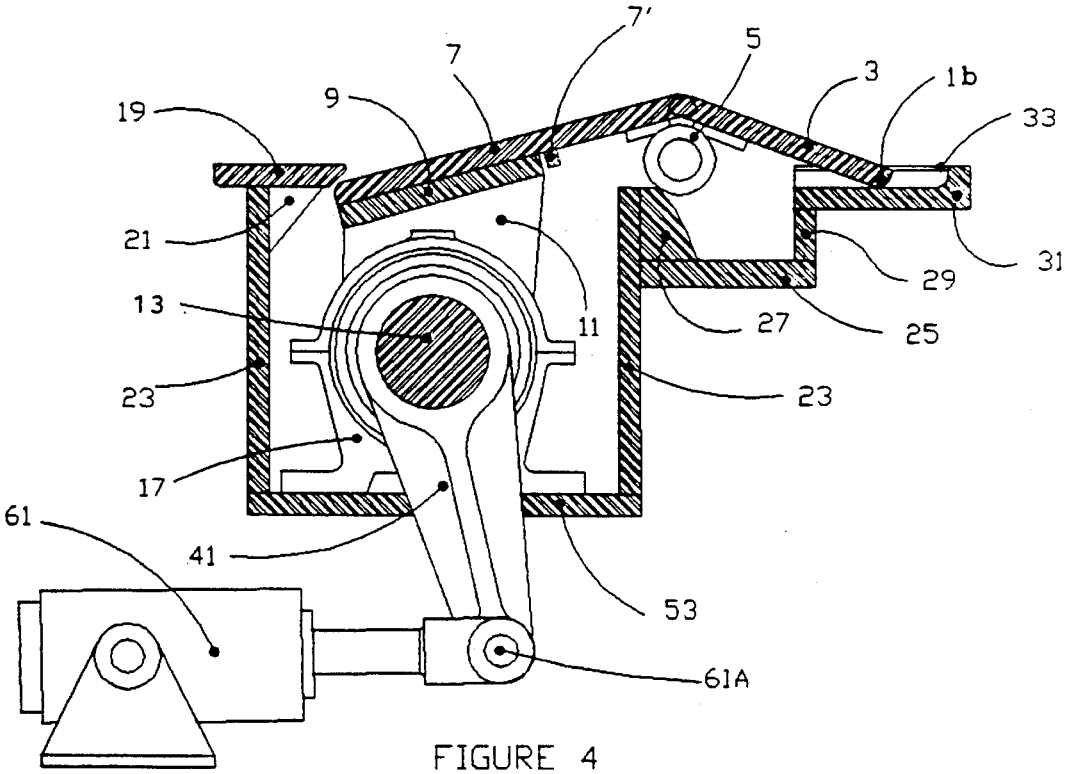
FIG. 4 is a partial sectional view taken along line 4—4 in FIG. 2, more particularly illustrating the components of the retractable speed bump in the raised or extended configuration.

Referring to FIG. 4 of the drawings, a cross sectional view of a preferred embodiment of the device 12, is shown in the extended/raised position, installed in the roadway, more clearly exposing the layout of the components included in FIGS. 1 & 2. In the extended position the bump so formed, rises to approximately 2.0 inches above grade, the leading plate item 7, being positioned at 15 degrees or such, to the horizontal surface, the intention herein being, to provide a positive warning by jolting, without causing damage to the motor vehicles.

The positioning of the bump with respect to angle of rotation of the shaft to creating specific vertical lifts of the bump elements, may be determined based upon due considerations of, other specifics such as, speed limits, detected vehicle approach speeds and the like, within the vicinity of the proposed installations. The exact angular positioning of the shaft is therefore not critical.

As an additional safeguard, a lane marker, of the type manufactured by the Stinsonite Company, or others, a portion thereof may be installed on the road surface adjacent to the in-road extremities of the device 12. to smoothen the approach or departure of the motor vehicle wheels from the raised edges of plates 7 & 3, in the event wherein the vehicle wanders onto the extreme lane edges.

Figure 5:
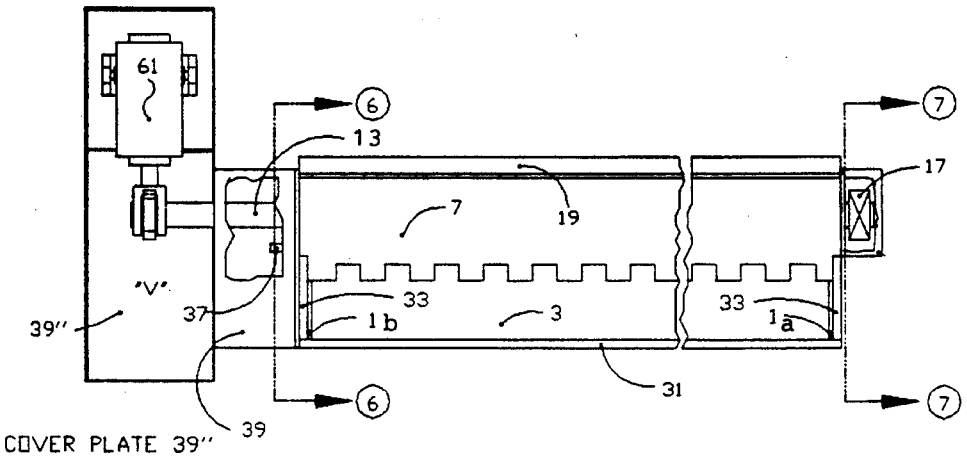
FIG. 5 is a partial plan view of the retractable speed bump in the lowered or retracted configuration.

Referring to FIG. 5 of the drawings, a partial sectional plan view of the improved retractable speed bump installed in the roadway or street, is shown in the retracted configuration, exposing a portion of the drive shaft 13. Also shown are, the bump drive shaft actuating arm 41, fixed to the drive end of shaft 13, the lower end of the arm 41 being further connected by a suitable metallic hinge pin 61A, to a motorized linear actuator, component 61 as shown in FIGS. 3 and 4. Component 61A being an integral part of the actuator component 61, of commercially known suppliers. A vault and/or above grade housing encompassing drive unit 61, is depicted by item "V". Where a below grade vault is preferred, a removable, access cover plate item 39" is provided as shown. Inclusive to a preferred embodiment of the improved retractable speed bump of this invention, a shaft/spindle 37, on which is mounted, a plurality of bump shaft locking cams 35, is partially shown, by exposing a portion of the "off-road" end of the device 12.

Figure 6:
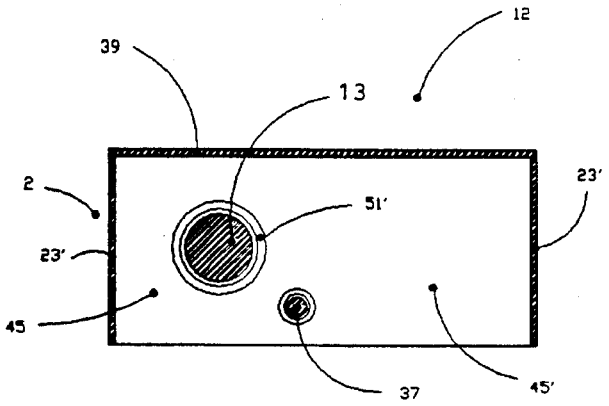
FIG. 6 is a partial sectional end view taken along line 6—6 in FIG. 5.

Referring to FIG. 6 of the drawings, a partial sectional end view of the device 12, installed in the roadway or street, taken along line 6—6 of FIG. 5 of the drawings, is shown, in particularly indicating, in a preferred embodiment of the improved retractable speed bump, a portion of the device "off-road" location wherein the shafts, components 13 and 37, extend to their respective actuator attaching locations.

Figure 7:
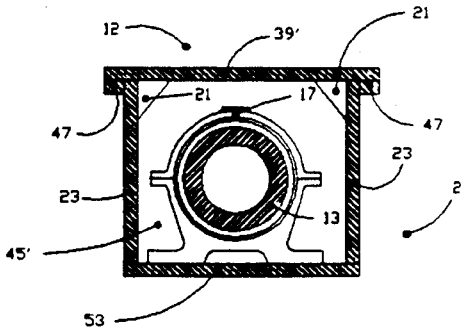
FIG. 7 is a partial sectional view taken along line 7—7 in FIG. 5.

Referring to FIG. 7 of the drawings, a partial sectional view of the device 12, installed in the roadway or street, taken along line 7—7 of FIG. 5 of the drawings, is shown, exposing one of the plurality of shaft support bearings 17, in the vicinity of the "in-road" extremity of the speed bump unit. The speed bump shaft 13, the trough container, comprising of components 21, 23, 39', 45', 47 and 53, all constructed of steel or other durable materials, are shown installed within the roadway or street surface identified generally as area 2.

As an integral part of this speed bump design and/or installation the base plate of the trough, item 53, is sloped downwards to the road embankment drainage swale, gutter, soak-away pit, or sump being part of the vault or storm sewer manhole drainage facility.

Figure 8A:
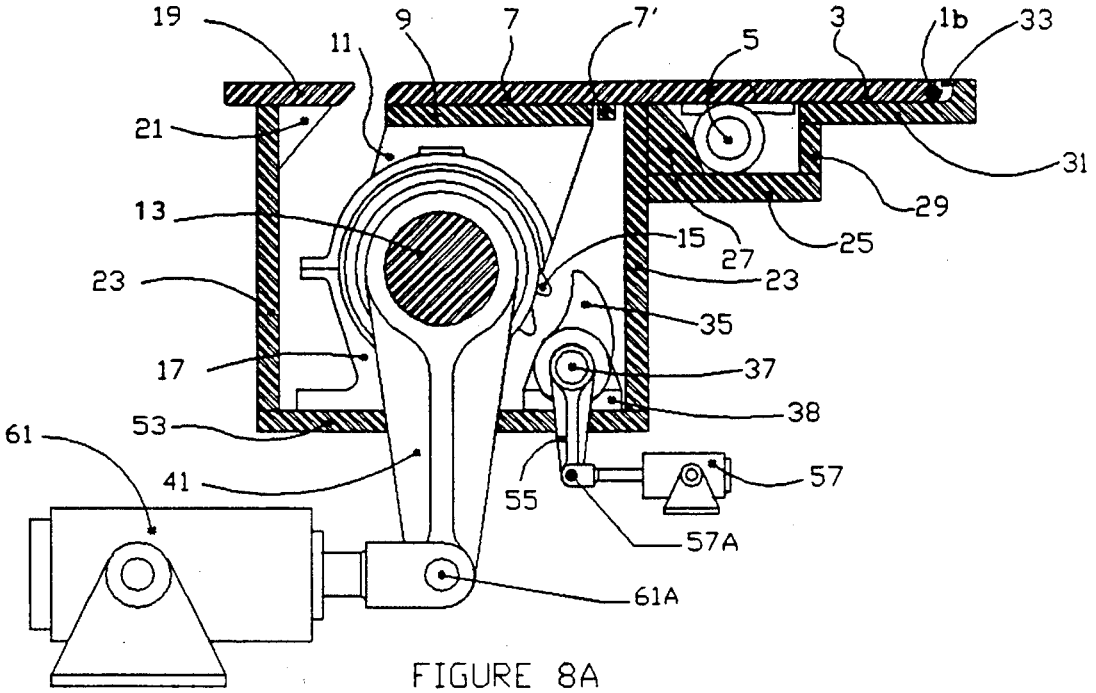
FIG. 8*a* is a partial sectional view taken along line 8*a*—8*a* in FIG. 1, more particularly illustrating the shaft position locking cam, in the "inactive", speed bump retracted position.

Referring to FIG. 8*a* of the drawings, a partial cross sectional view of a preferred embodiment of the device 12, taken along line 8A—8A of FIG. 1, is shown in the retracted/flat position, installed in the roadway, more clearly exposing the layout and arrangement of the components, and in particular one of each of a plurality of the locking stops or teeth 15, and locking cams 35, at their respective inactive positions. The locking cams 35, are shown fixed to, and supported by a locking shaft or spindle 37, which is further supported by a plurality of aligned bearings component 38, connected to the base of the trough 53.

Figure 8B:
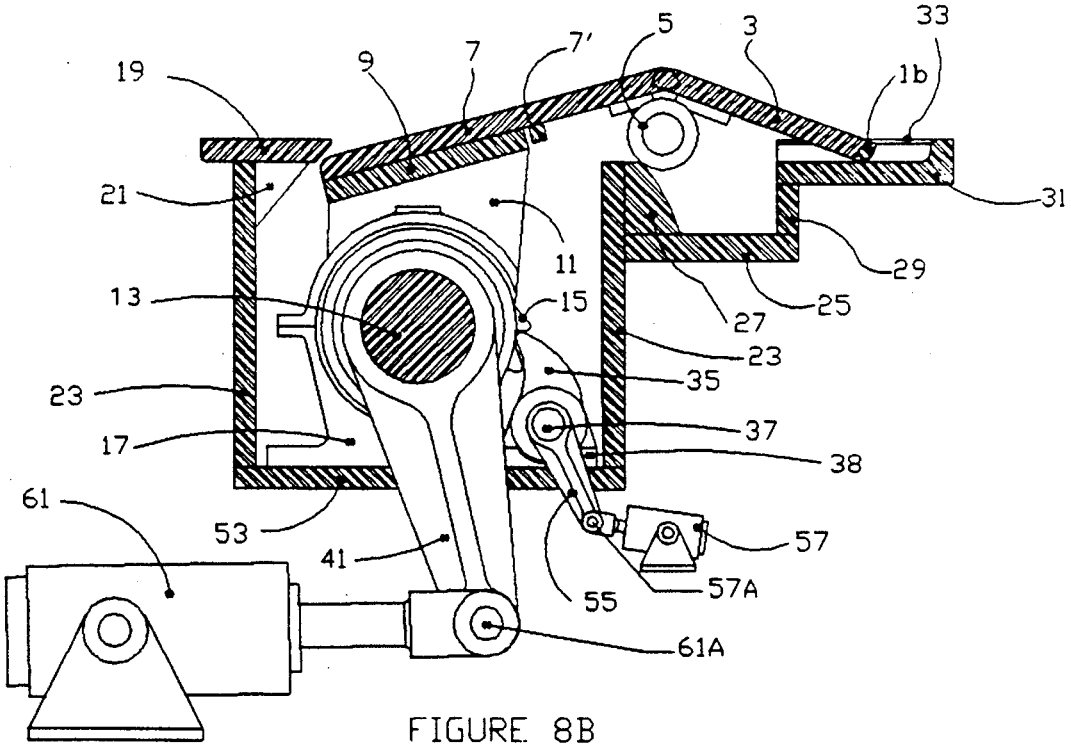
FIG. 8*b* is a partial sectional view taken along line 8*b*—8*b* in FIG. 2, more particularly illustrating the shaft position locking cam, in the "active", speed bump extended position.

Referring to FIG. 8*b* of the drawings, a partial cross sectional view of a preferred embodiment of the device 12, taken along line 8B—8B of FIG. 2, is shown in the extended/active position, installed in the roadway, more clearly exposing the layout and arrangement of the components, and in particular, one of each of a plurality the locking stops or teeth 15, and locking cams 35, at their respective active/engaged positions. The locking cams 35 are shown fixed to, and supported by a locking shaft/spindle 37, which is further supported by a plurality of aligned bearing components 38, connected to the base of the trough 53.

A unique feature of this invention, is depicted by the inclusion of a bearing surface on which the hinge 5 remains in rolling or sliding contact, such bearing plate being identified as 27, as referenced in FIGS. 3, 4, 8*a* and 8*b*, of the drawings. The plate or bar 27, with its curved surface, in cross section, provides a continuous contact surface for the roll hinges, 5. In the bump extended position, the said surface along 27, accepts a portion of the load which is placed on the bump plates and shaft during transmission of the vehicular traffic thereon, thereby reducing the forces which are transmitted towards, and into the shaft, item 13, and the motorized actuator, 61. Likewise, the bump shaft 13, the bearings 17, trough plates 19, 21, 23, 25, 31, and 53, collectively support and transmit the speed bump sustained loads, into the concrete or other sub-surface material, while the bump forming plates are in the horizontally/retracted, or active/raised positions.

Yet another unique feature of this invention, is depicted in FIGS. 3, 4, 5, 8*a* and 8*b* of the drawings, wherein an alignment guide bar, 7' is shown attached by weldment or other suitable means, to plate 7, in order to provide easy alignment of the said plate, 7, on the longitudinal support bracket 9, the preferred method of attachment of 7, to 9, being by countersunk self locking bolting.

Collectively, these features assure for the easy replacement of 7, with 7', 5, 3 with its fixed guide pin 1. Likewise, for relocation and/or reuse purposes, 9, 11, 13, 15, 17, 35, 37 and 38, can be removed from the trough, by the unbolting of 17 and 37, from their support bases on the trough base plate 53. The preferred method of securing these two items to the base of the trough, being by bolts protruding upwards from said baseplate 53, and lock washer with nuts placed on top of the bearing support pads 17 and 38.

In the event of required relocation of the device, all the moving parts of the speed bump of this invention, complete with drive unit and along with controls are removable for re-use elsewhere. The trough, comprising of 19, 21, 23, 25, 27, 29, and 31 may remain insitu, wherein it may be filled in with concrete or other suitable asphaltic or gravel road base construction materials.

Sensing of traffic conditions and signal transmission to a central control unit, may be provided, from devices of a variety of known, approved and satisfactory suppliers of such means for vehicle speed detection and the transmission of related data in analog or digital modes, as made by, Peek Traffic Inc., Laser Technology Inc., MPD Inc., Tibar Industries Inc., and others.

The central control unit comprising of, electronic multi-function signal receivers, integrator, programmable controllers and additional devices of a known, wide range of control functions may be provided as one unit including the actuator, as in the case of those made by, RACO International Inc., or by a number of other approved suppliers.

Reference is being made herein to a number of optional operating functions available to encompass all possibly known applications of the speed bump control, forward and reverse signalling, computer link to a central control station, and the like. The controllers are mounted in an above or below ground, easily accessible weather proof housing. Remote telemetric or on-site re-calibration and/or re-programming of the controllers is facilitated.

The prime mover is a self locking and/or magnetic braking, reversible linear actuator 61, powered by AC or DC voltage with internally and/or externally mounted switches, starters, relays, potentiometers, inductive transmitters, contactless sensors, controllers, feedback devices, adjustable limit switches, mechanical and electrical disengaging mechanisms wherever a solid handwheel is provided for manual operation or adjustments, and the like all such being typical of existing art and as manufactured by Raco International Inc., Duff-Norton Co., and others. FIG. 5 shows the linear actuator 61, mounted in a horizontal configuration, being located in a typical below grade vault. The said motorized linear actuator may be mounted in any angular configuration, relative to the axis of shaft 13, above or below the grade. In every location the unit will be installed in weatherproof protected housing.

From the foregoing it will be seen that a highly practical and improved retractable speed bump is provided. The unit lends itself to an easily executed, at-grade installation, in the series (juxtaposed), parallel (rumble strip), or single module configuration. The transmission of motion is minimized to the use of a small number of integral members, providing the highest degree of structural integrity of the whole. The electrical controls provide for a wide range of energy efficient and fail safe operating possibilities, is essentially maintenance free once calibrated.

I have described a typical preferred configuration and application of my invention, and do not wish to be limited or restricted only to the specific details outlined herein but I wish to reserve to myself, any modifications or variations that may appear to those skilled in the art as set forth within the limits of the following claims.

I claim:

1. A motorized retractable speed bump, comprising: first and second interlocking rectangular bump plates, said bump plates hingedly connected together along their longitudinal edges by a plurality of roll hinges;

a first and a second guide pin longitudinally extending from said first bump plate, said first and said second guide pins located at opposite ends of said first bump plate;

a shaft extending longitudinally below and fixedly attached to said second bump plate;

a first motorized linear actuator;

an actuating arm having a first and a second end, said arm fixedly attached at said first end to said shaft and rotatably attached at said second end to said first motorized linear actuator;

a trough container, said container having a curved surface extending longitudinally therein, and a pair of channelled slots for slidably receiving said first and said second guide pins;

wherein said shaft extends longitudinally through said container and supports said second bump plate, said plurality of roll hinges slidably engages said curved surface said first bump plate being supported by said plurality of roll hinges and by said guide pins inserted into said channelled slots;

and wherein when said first motorized linear actuator is activated, said actuator arm turns said shaft causing said second bump plate to move in the direction of said shaft rotation and causing said plurality of roll hinges to move upwardly along said curved surface causing said first and said second bump plates to hinge about said plurality of roll hinges to form an angularly raised surface above said trough container.

2. The motorized speed bump of claim 1 wherein said shaft has a plurality of radially extending teeth extending therefrom and wherein said speed bump further comprises at least one shaft locking cam angularly directed towards said teeth of said drive shaft, said shaft locking cam movably actuated by a second drive shaft, said second drive shaft fixedly attached at one end to a second actuating arm, said second actuating arm rotatably attached to a second motorized linear actuator, whereby when said second motorized linear actuator is activated, said second actuating arm rotates said second drive shaft causing said at least one shaft locking cam to engage one of said plurality of radially extending teeth extending from said drive shaft.

3. The motorized speed bump of claim 2 wherein said second motorized linear actuator is operably connected to said first motorized linear actuator in opposite relationship whereby when said first motorized linear actuator is extended, said second motorized linear actuator is retracted, and when said first motorized linear actuator is retracted, said second motorized linear actuator is extended.

4. The motorized speed bump of claim 2 wherein said plurality of radially extending teeth are spaced apart circumferentially on said shaft such that said at least one shaft locking cam may engage said radially extending teeth allowing said first and said second bump plates to be raised and locked into place at a plurality of levels.

5. The motorized speed bump of claim 1 wherein said shaft is of a single diameter.

6. The motorized speed bump of claim 1 wherein said shaft is of varying diameters.

7. The motorized speed bump of claim 1 wherein said shaft further comprises a plurality of axially aligned beatings.

* * * * *

UNITED STATES PATENT AND TRADEMARK OFFICE

CERTIFICATE OF CORRECTION

PATENT NO. : 5,509,753
DATED : April 23, 1996
INVENTOR(S) : Clinton C. Thompson

It is certified that error appears in the above-identified patent and that said Letters Patent is hereby corrected as shown below:

Claim 7, Cloumn 8, lines 24 and 25, change "beatings" to --bearings--

Signed and Sealed this

Tenth Day of November 1998

*Attest:*

*Attesting Officer*

BRUCE LEHMAN

*Commissioner of Patents and Trademarks*